United States Patent [19]

Feinberg

[11] 4,251,024

[45] Feb. 17, 1981

[54] AUTOMATIC VENT DAMPER

[75] Inventor: Emanuel Feinberg, Southfield, Mich.

[73] Assignee: Paragon Resources, Inc., Warren, Mich.

[21] Appl. No.: 880,611

[22] Filed: Feb. 23, 1978

Related U.S. Application Data

[63] Continuation-in-part of Ser. No. 733,260, Oct. 18, 1976, Pat. No. 4,102,629.

[51] Int. Cl.[3] ..... F23L 11/00

[52] U.S. Cl. ..... 236/1 G; 126/285 B; 431/21

[58] Field of Search ..... 236/1 G, 45, 11, 21 B, 236/91; 126/285 B; 431/20, 21; 110/163; 137/72, 74, 76

[56] References Cited

U.S. PATENT DOCUMENTS

| | | | |
|---|---|---|---|
| 2,037,363 | 4/1936 | Branche | 236/1 G X |
| 2,112,554 | 3/1938 | Beam | 431/20 |
| 2,129,059 | 9/1938 | Herbster et al. | 236/11 |
| 3,906,253 | 9/1975 | Farley | 236/91 |
| 4,017,024 | 4/1977 | Grostick et al. | 110/163 X |
| 4,021,187 | 5/1977 | Schulte et al. | 126/285 B |
| 4,079,884 | 3/1978 | Sherman | 236/16 |
| 4,102,629 | 7/1978 | Feinberg | 126/285 B |
| 4,108,369 | 8/1978 | Prikkel | 126/285 B |

*Primary Examiner*—Albert J. Makay
*Assistant Examiner*—Henry Bennett
*Attorney, Agent, or Firm*—Krass & Young

[57] ABSTRACT

An automatic vent damper for combustion devices such as furnaces which closes the combustion chamber exhaust vent when the furnace burner is off to conserve heat and prevent backdrafts. A damper blade pivotally mounted in the exhaust vent is closed by an electrically-operated damper motor operating against a torsional spring urging the damper plate into the open position, the damper motor being energized whenever burner operation is not in demand by the automatic controls. When the controls call for burner operation, the motor is deenergized and the damper blade moves to the open position under the influence of the torsional spring. A limit switch senses the damper blade achieving the open position and enables burner operation. An electrically conductive, thermally fusible link is positioned within the vent in series with the power supply for the control circuit powering the damper motor and burner controls so that in the event a failure results in burner operation with the damper blade closed, the fusible link melts and thereby deenergizes the damper motor and burner controls allowing the torsional spring to move the damper blade to the open position. The damper blade and actuator components are mounted on a cast iron housing mating with the vent ducts to prevent corrosion or temperature-induced distortions from jamming the damper blade, providing reliable operation over extended periods. A solid state relay or delay switching device is alternatively utilized to control energization of the damper motor to insure reliable operation.

27 Claims, 10 Drawing Figures

AUTOMATIC VENT DAMPER

CROSS-REFERENCE TO RELATED APPLICATION

This application is a continuation-in-part of application Ser. No. 733,260, filed Oct. 18, 1976, which is now U.S. Pat. No. 4,102,629.

BACKGROUND OF THE INVENTION

Combustion heating devices such as oil and gas fired furnaces produce heat by burning oil or gas within a combustion chamber in a heat exchanger and exhausting the products of combustion through an exhaust vent. Room air or other fluid to be heated is circulated around the heat exchanger thereby being heated. With the recent dramatically increased cost of fuels, the efficiency of such devices has become of greatly increased significance. The loss of heat which occurs through venting of the combustion chamber to the outside when the burner is not fired, represents a potential energy saving which could be realized if the vent were closed after discontinuance of the burner operation. The heated gases within the combustion chamber could be retained allowing continued heat extraction from the heat exchanger which would otherwise be lost to the outside. Diverters for mixing room air with the exhaust gases are commonly used and loss of warm room air could also be reduced, as well as backdrafts if the exhaust vent were blocked whenever the heating device was not in operation.

Automatic vent damper devices of this sort have thus long been proposed and utilized. A complicating factor in their design is that of adequate safety features, since if the vent damper were closed during burner operation, overheating could occur and the products of combustion could enter the occupied spaces of the building. Such gases being toxic, their potential leakage presents a considerable health hazard, while the high temperatures could produce a fire.

This safety problem is particularly acute because of the extended time periods during which the furnace operates without maintenance. The life of typical furnaces is sufficiently long that any such automatic vent damper operating devices should operate reliably for a considerable period of years with minimal maintenance.

Any such device should also function properly in the eventuality of to-be-expected malfunctions, i.e., power failures, failure of the burner controls, valve failures in which the burner valve remains in the stuck open position even though the controls are calling for cessation of burner operation.

Additionally, these devices should be able to endure wide variations in temperature and the effects of a humid, rust-inducing environment which over a period of years could result in the sticking or jamming of moving parts such as the damper plates.

The controls for such a device should also ideally be free from regular maintenance requirements.

In some automatic vent damper devices which have heretofore been utilized, the damper is opened by sensing of abnormally high temperatures by a thermostatic device which causes the damper actuator to open the damper. However, when the damper is opened, the vent cools sufficiently such that the thermostatic device damper again is allowed to be closed causing a recycling while the initial failure may go undetected.

Another similar problem is encountered in those systems in which a backup control is built into the system such that upon failure of one control component, another control component acts to take over and produce the proper control of the fuel or damper actuator. Similarly, the failure of the first component will not be detected since the heating device may still be operated. In this event, an undetected failure may continue to be unserviced until a final failure occurs, which the failsafe design no longer can accommodate.

Another disadvantage of the thermostatic devices typically utilized in these designs is that they cannot be made to respond reliably to a given temperature over the periods of service required. Thus, reliable damper opening temperature may not be achieved over the service life of the actuator.

Another approach has involved the use of a fusible mechanical connection in the damper actuator which provides the driving connection tending to close the damper. The fusible connection melts when a high temperature condition develops indicating burner function to allow a damper open bias actuator such as a weight or spring to open the damper.

This approach is described and claimed in the above-referenced parent application.

While offering the advantage of reliably opening the damper in the event of burner operation, the fusible connection is difficult to design without encountering plastic creep at temperatures below the proper fusing temperature.

It is, accordingly, an object of the present invention to provide an automatic vent damper device for combustion heating devices which is failsafe in operation, in that if the burner operation continues, the damper is moved to the open position regardless of the condition of the system controls.

It is yet another object of the present invention to provide an automatic vent damper operating device in which the failures of the burner controls result in a reliable opening of the vent damper in response to the resultant build-up of high temperature conditions.

It is yet another object of the present invention to provide an automatic vent damper device in which the effects of corrosive conditions or high temperatures are resisted to greatly reduce the incidence of jamming or malfunction of the damper blade.

It is still another object of the present invention to provide such an automatic vent damper device in which upon a failure of the system such as to require the functioning of the failsafe feature, burner operation is interrupted so that the malfunction becomes apparent.

It is yet another object of the present invention to provide a temperature sensitive vent damper which accurately and reliably responds to a predetermined temperature level to cause the damper to be opened.

SUMMARY OF THE INVENTION

These and other objects of the present invention, which will become apparent upon a reading of the following specification and claims, are accomplished by an automatic vent damper including a pivotally mounted damper blade, biased to the open position by a torsional spring and which is rotated to the closed position by a damper motor. The damper motor is deenergized by a solid state or other switching device which is activated by the burner controls whenever the controls call for an increase in temperature, i.e., burner operation. An electrically conductive thermally fusible link is disposed extending into the vent opening provided in the damper housing which fuses at a temperature level corresponding to burner operation with the damper blade closed and in series with the power supply for the damper motor and burner controls so that the damper allows the torsional spring to open the damper blade. The fusible link being in series with the burner controls prevents energization of the burner controls until the fusible link has been replaced. A limit switch is provided responsive to the damper blade position to preclude operation of the burner until the damper is in the open position. The damper housing is constructed of cast metal, such as iron or aluminum, and highly resistant to corrosion and thermal distortions tending to produce jamming of the damper plate such as to provide reliable operation of the damper.

DESCRIPTION OF THE DRAWINGS

FIG. 1 is a diagrammatic representation of a combustion heating device with the automatic vent damper device according to the present invention installed with the damper blade in the open position, with the burner on.

FIGS. 9 and 10 are schematic representations of alternate forms of the controls depicted in FIG. 8.

DETAILED DESCRIPTION

Figure 1:
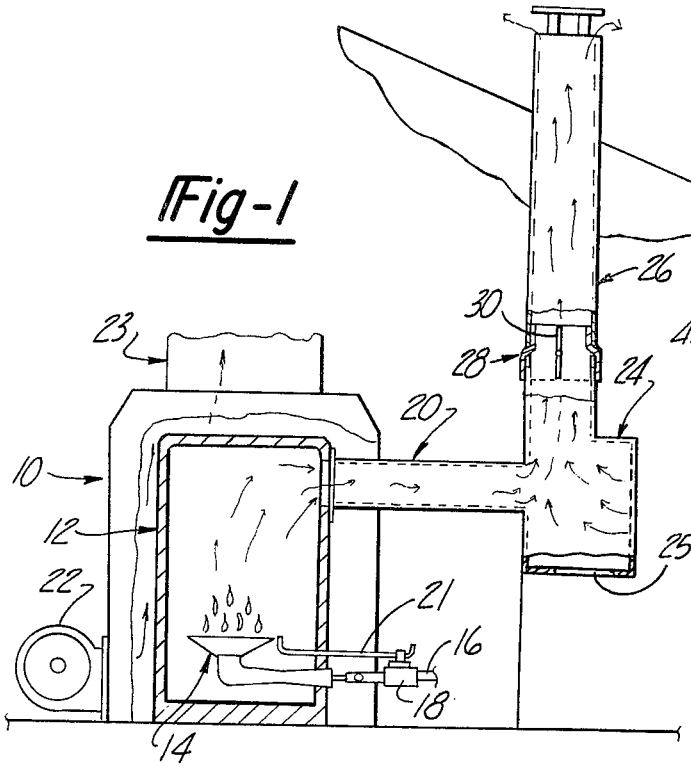

In the following detailed description, certain specific terminology will be utilized for the sake of clarity and a specific embodiment described in accordance with the requirements of 35 USC 112, but it is to be understood that the same is not intended to be limiting and should not be so construed inasmuch as the invention is capable of taking many forms and variations within the scope of the appended claims.

The present invention is contemplated for application to a combustion heating device such as a combustion furnace 10 including a combustion chamber 12 within which is located the burner 14 supplied with fuel such as gas, through a gas supply pipe 16, the gas flow being controlled by an automatic valve 18. The valve 18 is operated by thermostatic controls and a damper position switch to be described which in turn control the flow of gas to the burner 14. A separate pilot supply 21 may be provided to provide gas to the pilot light when the burner 14 is not on. The gas is thus burned within the combustion chamber 12, the products of combustion passing out through an exhaust vent ducting means 20. The resultant heating of the combustion chamber 12 walls acts as a heat exchanger circulating return room air around the combustion chamber 12 and out a warm air plenum 23 to the warm air ducting. The exhaust vent 20 passes into a draft hood or diverter 24 in which an inlet 25 allows relatively cool room air to be mixed with the products of combustion as they pass up the chimney section 26 of the vent ducting.

According to the concept of the present invention, there is provided in the chimney section 26 of the exhaust duct means an automatic vent damper 28 including a damper blade 30, shown in FIG. 1, in the open position with the burner 14 in operation allowing the hot combustion gases and the room air drawn into the diverter 24 to pass up and out of the building in which the furnace 10 is located.

Figure 2:
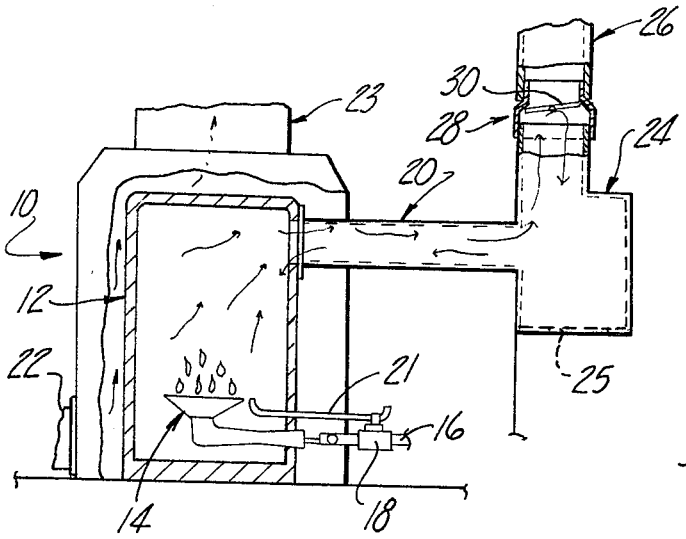
FIG. 2 is a diagrammatic representation depicting the heating device shown in FIG. 1 with the damper blade in the closed position.
Figure 4:
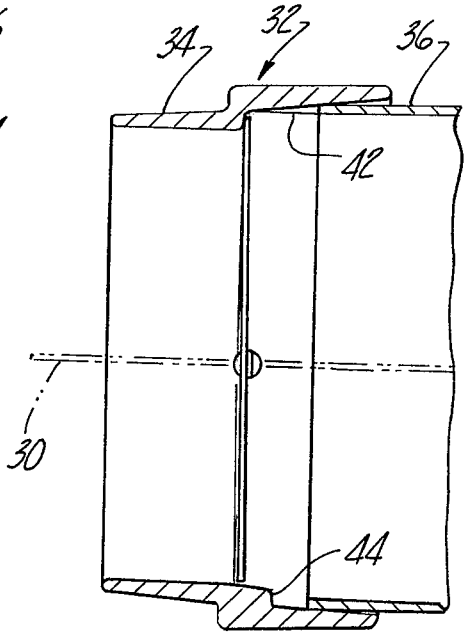
FIG. 4 is a sectional view taken through the damper housing showing the damper plate in the closed position.

Upon shutoff of the burner 14, as shown in FIG. 2, the damper blade 30 has been positioned to block off the chimney section 26 such as to prevent the escape of the warm air either from the diverter inlet opening 25 or from the interior of the combustion chamber 12 such that the retained heat of the combustion chamber 12 may be utilized by continuing to circulate the air about the combustion chamber 12.

This also prevents the escape of room air through the diverter inlet 25 or the entrance of backdrafts out of the diverter inlet opening 25.

Figure 3:
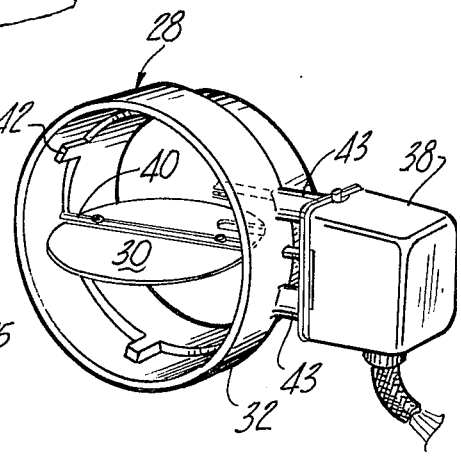
FIG. 3 is a perspective view of the automatic vent damper including the damper housing and the associated damper actuator housing.

The automatic vent damper device 28, as shown in FIG. 3, includes a damper housing 32 which is adapted to receive sections of the exhaust vent ducting over the outside diameter 34 of one section of the housing 32 and within the inside diameter 36 of the larger section of the housing 32. The damper blade 30 is pivotally mounted within the housing 32, and is positioned by means of an actuator contained within the actuator cover 38 acting on a cross-shaft 40 to rotate the damper blade 30 to the closed position.

The actuator components housed within a cover 38 are mounted to the damper housing 32 on cast pedestal mounts 43.

The damper blade 30 is mounted offset on the cross shaft 40 such as to engage an inner shoulder 42 in the closed position to provide a stop.

Damper housing 32 is preferably formed of a close-grained cast iron of relatively heavy construction such as to provide a sturdy and stable support for the damper blade 30 such that the effects of distortions or corrosion on the reliability of the movement of the damper blade 30 will be avoided.

Shoulders 42 are provided axially positioning the end of the connected vent duct section so as to clear the ducting from interference with the blade 30.

Figure 5:
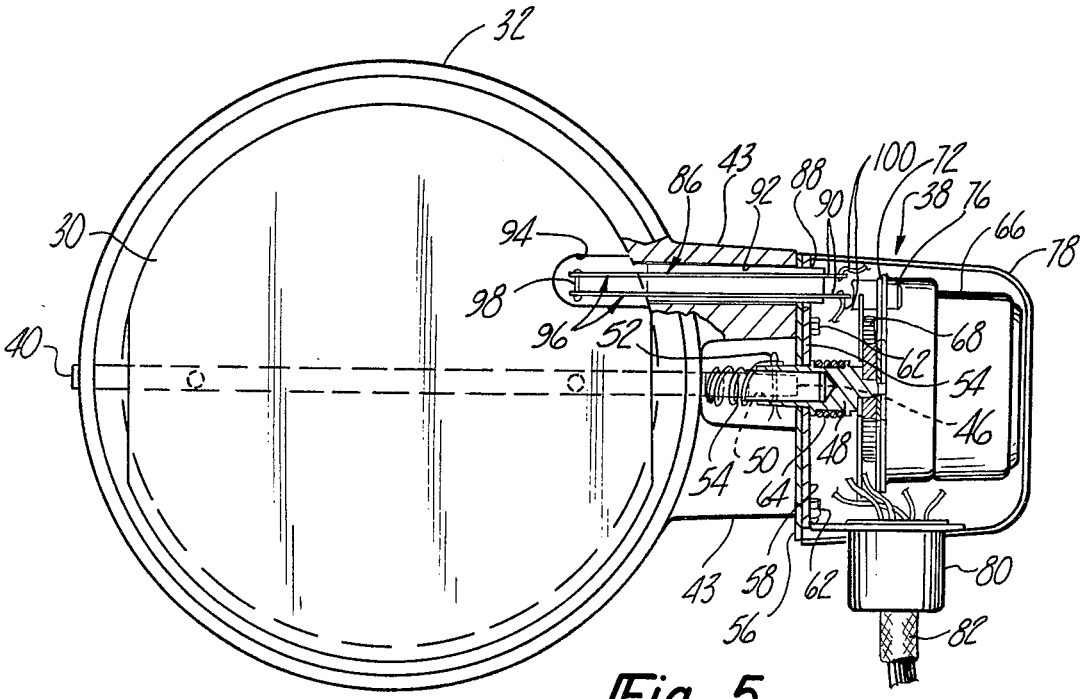
FIG. 5 is an endwise partially sectional view of the damper housing and the associated damper actuator.

The actuator components contained with the actuator cover 38 are shown in partial section in FIG. 5. The cross shaft 40 extends through a corresponding opening in the damper housing 32 intermediate the pedestal mounts 43 with an end section 46 slidably received within a bore 50 in the drive pin 48. To establish a driving connection with the cross shaft 40, a drive connector 52, such as a cotter pin, D-clip or roll pin is provided extending through cross holes in the end section 46 and the drive pin 48. These cross holes are aligned when the damper blade 30 is in closed position and the damper motor (described below) is in the stop or stalled position. A tensioner torsion spring 54 is provided anchored to the drive connector 52 and the cross shaft 40 takes up the lost motion created by oversizing the cross holes in the cross shaft 40 and drive pin 48.

The drive pin 48 extends within the cover 38, through a base plate 56 and a cover mounting plate 58.

The base plate 56 is secured to the pedestal mounts 43 by means of countersunk self-tapping machine screws 60 (FIG. 6) while the cover mounting plate 58 is mounted to the base plate 56 by means of machine screws 62.

Figure 6:
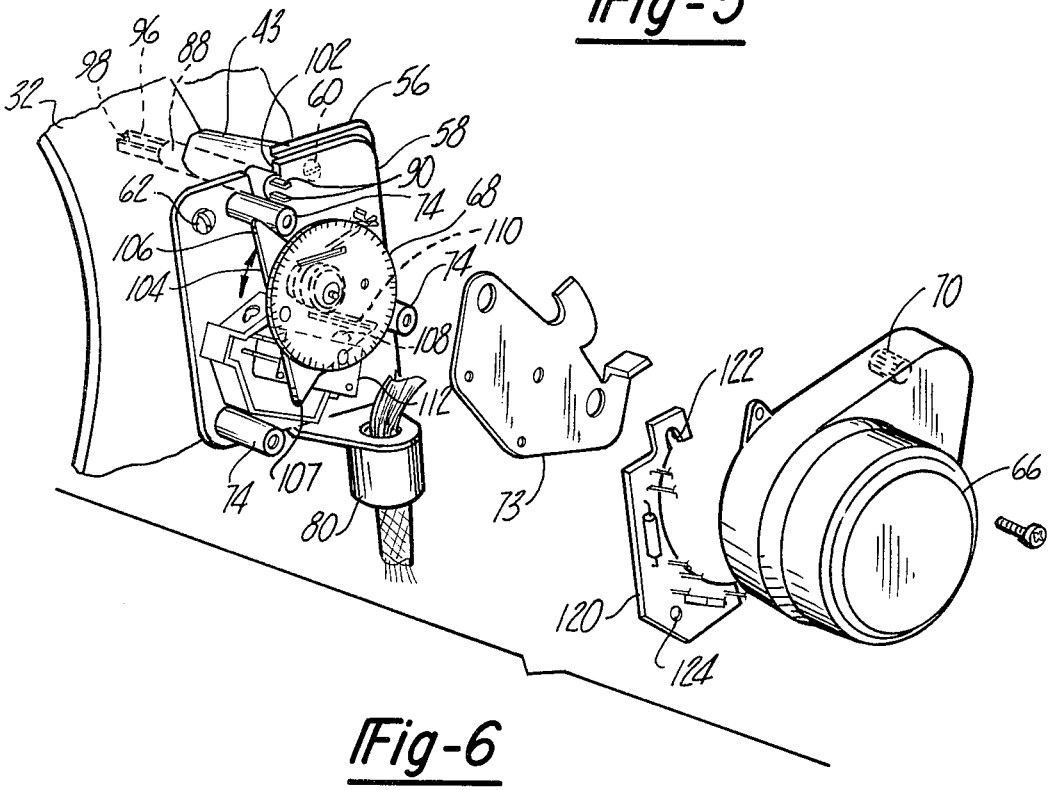
FIG. 6 is an exploded perspective view of typical damper actuator components.

Drive pin 48 is adapted to be urged in a first direction tending to open the damper blade 30 by means of a torsional wind-up spring 64 wound about the outside diameter of the drive pin 48 disposed within the actuator cover 38. The drive pin 48 is also adapted to be driven in a second opposite direction by a damper drive motor 66 which acts to rotate a drive gear 68 by means of a motor output pinion gear 70 (FIG. 6). The damper drive motor 66 is secured to a mounting plate 72 which is mounted to the cover mounting plate 58 by means of mounting posts 74 receiving screws 76. A socket 80 of the various electrical leads is provided receiving a cable 82 from the burner control circuit.

A fusible link assembly 86 is provided according to the present invention which includes a ceramic spacer cylinder 88 having spaced electrically conductive strips 90 extending through appropriate openings therein with the ceramic spacer 88 being disposed in a bore 92 formed within one of the mounting pedestals 43. The conductive strips 90 extend into the exhaust vent space by passing into the interior of the housing 32. The damper blade 30 is formed with a cut-out 94 which is required to bypass pilot light combustion gases, the cut-out 94 being sized and extending through to the periphery thereof so that the projecting strip portions 96 are cleared during rotation of the damper blade 30.

Figure 7:
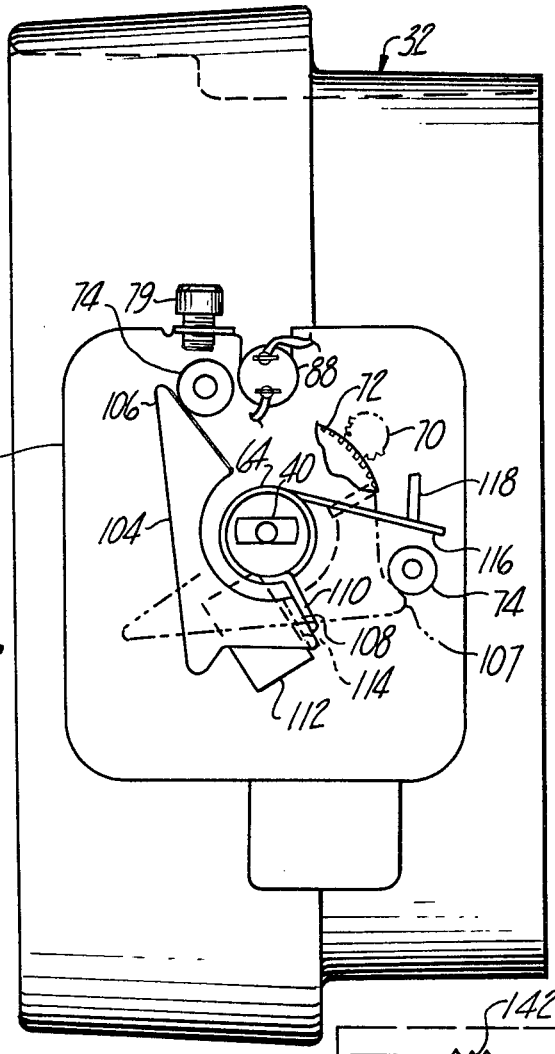
FIG. 7 is an endwise diagrammatic representation of the driver and limit actuator components shown in FIGS. 5 and 6.

As can best be seen in FIGS. 5 and 7, the fusible link assembly 86 extends into the cut-out 94 with the damper blade 30 closed. That is, the fusible link assembly 86 is centered on the plane in which the cross shaft 40 axis lies to place the fusible link assembly in the plane of the damper blade 30 with the damper blade 30 in the closed position.

Thus, any flue gases must pass directly over the fusible link assembly 86.

Joining the outer portions 96 of the conductive strips 90 is a thermally fusible link 98, which is comprised of an electrically conductive, relatively low melting point metal alloy, like a suitable solder composition which would melt at a temperature compatible with the burner design and normal operating temperature of the vent. For a typical furnace design, this temperature has been found to be on the order of 400° F. This temperature level is produced with the burner 14 in operation and the damper blade 30 closed, and is well above that existing during normal functioning of the furnace, i.e., with the burner 14 operating with the damper blade 30 open or with the damper blade 30 closed and the burner 14 not operating.

Electrical leads 100 are provided for respective strips 90 and are incorporated in the control circuit for the damper drive motor 66 as will be described in further detail herein. The ceramic spacer cylinder 88 has slotted sides which cooperate with a slot 102 formed in the mounting plate 58 so as to secure the in and out position of the strips 90 and the ceramic spacer cylinder 88 after assembly. The fusible link assembly 86 is positioned within the housing 32 as indicated and then the cover mounting plates 58 and components secured thereto positioned on the base plate 56, the slots on the ceramic spacer cylinder 88 being engaged by the slot 102 provided in the cover mounting plate 58 (FIG. 6).

The drive gear 68 has affixed thereto a stop plate 104 such that upon continued rotation of the drive gear 68 in the open direction, under the urging of the torsion spring 64, a stop ear 106 engages a mounting post 74. This correctly positions the damper blade 30 in the full open position.

A second ear 107 formed on the stop plate 104 is located to move into engagement with another one of the mounting posts 74 when the drive motor 66 has rotated the damper blade 30 to the closed position. This provides a stop means correctly positioning the damper blade 30 in the fully closed position.

The stop plate 104 is also provided with a tab 108 which is engaged with one end 110 of the torsional spring 64 which tab 108 also serves to engage a limit switch 112 having an actuating bar 114 (FIG. 7).

The other end 116 of the torsion spring 64 is anchored against a tab 118 formed on the bracket mounting plate 58. Thus, the damper blade 30 is positioned by abutment of the ear 107 with a mounting post 74 in the closed position, and in the full open position by which it is moved by the torsional wind-up spring 64, the stop ear 106 engaging mounting post 74.

The limit switch 112 is integrated with the burner controls as will be described hereinafter such that the gas control valve 18 is not energized until the damper blade 30 has been physically positioned in the open position.

The various control components associated with the damper actuator 28 are mounted on a component board 120 which is affixed alongside the damper actuator motor 66 on two of the mounting posts 74 by means of the slots 122 and hole 124 receiving the mounting screws 76.

The damper drive motor 66 is of the shaded pole type, that is, moves to a stalled stop position when the voltage is applied and remains in that position as long as the voltage remains applied. This position is in correspondence with the closed position of the damper blade 30 under the impressment of the control voltage. Thus, the torsional spring 64 is overcome whenever the damper motor 66 is energized to move to the closed position, with the torsional spring 64 positioning the damper blade 30 in the open position at all other times.

Figure 8:
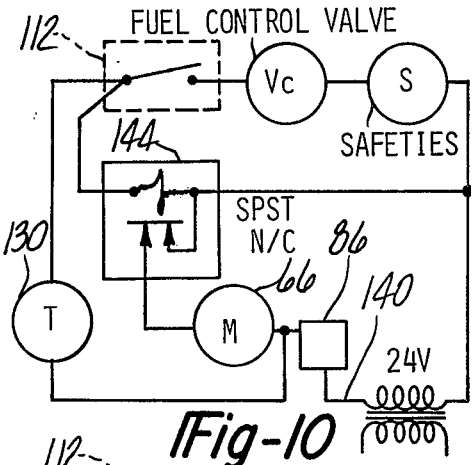
FIG. 8 is a schematic diagram of one combination of controls associated with the automatic damper control device according to the present invention showing its relationship with the burner control system.
Figure 8:
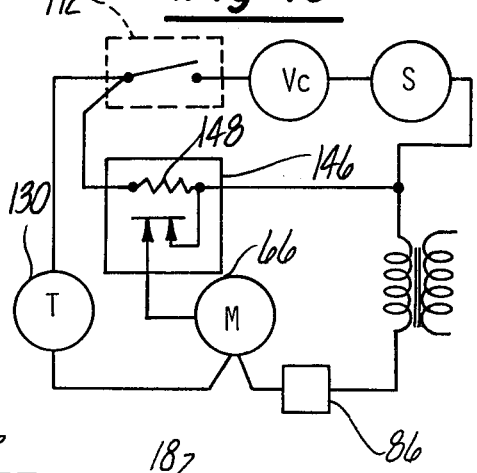
Figure 8:
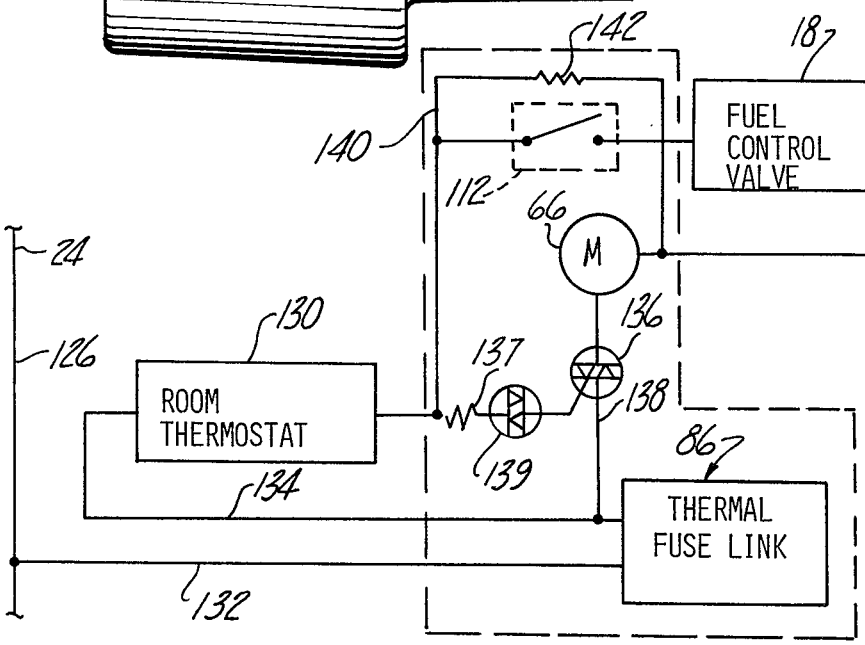

FIG. 8 depicts in schematic form the integration of the damper control with the furnace controls. The 24 volt AC control voltage is applied across lines 126 and 128 with the thermal fusible link placed in series with the room thermostat 130 via leads 132 and 134. In addition, a solid state switching device, i.e., the triac 136, is controlled by the voltage output of the room thermostat 130 such that when the room thermostat 130 calls for the furnace burner 14 to be activated, the triac 136 is in blocking condition in which the control voltage applied across line 138 is blocked by the gate terminal, such that the damper motor 66 is in a deenergized state. Line 140 and resistor 142 establish the proper voltage level applied to the motor 66 to establish the proper closing movement of its output.

In order to reduce the sensitivity of the triac 136 to false triggering by slight leakage currents caused by shorts, and "spikes" due to the presence of timer controls, etc. integrated into the system controls, the gate of the triac 136 is connected via a resistor 137 and diac 139. These elements tend to attenuate the effects of slight or trickle currents caused by shorts and transient voltage surges, respectively, to reduce the incidence of false triggering of the triac 136 in such circuits.

With the damper motor 66 deenergized, the torsional wind-up spring 64 controls the position of the damper plate 30 acting to rotate the damper plate to the open position. When the damper plate 30 reaches the open position, the tab 108 formed on the plate 104 closes the limit switch 112 such that the room thermostat may energize the gas burner supply valve 18.

Upon the room thermostat calling for shutting off of the furnace burner 14, the room thermostat voltage no longer blocks the triac 136 such that the damper motor 66 is energized which rotates the pinion gear 70 and the drive gear 72 against the resistance of the torsional spring 64 rotating the damper plate 30 into the closed position, with the ear 107 engaging a mounting post 74.

In the event the burner is somehow activated in the absence of a room thermostat control signal, the resulting increase in temperature within the damper housing 32 with the blade in the closed position causes the fusible link 98 to be melted. The fusible link 98 is in series with the burner control circuit and breaks the circuit applying the control voltage to the room thermostat 130 and the triac 136, which deenergizes the drive motor 66 allowing the torsional spring 64 to again move the damper to the open position with the ear 106 in engagement with the pedestal 74. This also interrupts the control valve circuit such that the voltage can no longer be applied to the fuel control valve 18.

Accordingly, the furnace can no longer be operated since the fuel control valve 18 cannot be energized, except for failures involving a stuck fuel control valve. The furnace 10 will thus be shut down which alerts the residents to the fact that a malfunction has occurred and requires a replacement of the fusible link 98 before the furnace can again be operated, with the service personnel being alerted to the fact that there has been malfunction in the system and the need for correction of what could be a very dangerous situation.

The system is entirely automatic, as can be appreciated, and highly reliable in operation due to the fail-safe damper motor drive 66 with the spring release principle of operation. If there is a voltage failure or any other failure which would result in the damper motor 66 not receiving its applied voltage, the spring automatically moves the damper plate 30 to the open position. The housing 32 is of heavy cast metal such as iron or aluminum which minimizes any problems with jamming which might occur due to corrosion or thermally-induced distortions such that the unit should be highly reliable in operation for a considerable period of time. The solid state switching of the damper motor 66 by the triac 136 eliminates the wear out of relay contact points, such that maintenance for this component should be minimal. The melting of the fusible link at a predetermined temperature level is highly reliable and predictable in operation over a long period of service as compared with thermostatic devices.

The non-mechanical connection of the fusible link with its cut-off of the power to the damper motor 66 precludes the "creep" movement which might occur upon use of a fusible mechanical connection element and remains highly predictable in performance at predetermined temperature levels as distinguished from typical thermostatic devices. This has been achieved by a relatively simple, inexpensive device to accordingly achieve the objects of the present invention.

While the triac switching offers the advantage of reliability and low maintenance requirements, relays and switches may be utilized.

FIG. 9 illustrates the use of a single pole, single throw normally closed relay 144, which is energized upon the burner 14 being activated to deenergize the motor 66 and insure opening of the damper blade 30. Upon ceasing of burner operation, the SPST NC relay 144 again closes to energize the motor 66 and open the damper blade 30.

FIG. 10 illustrates a delay feature. Oil burner controls typically incorporate a purge cycle to eliminate the products of combustion occurring after shut off. Similarly, some gas control valves are delayed in operation for up to a minute.

Accordingly, a delay relay 146 is incorporated in the circuit, which may be of the heated element type. That is, the delay relay means upon being energized causes a heating element 148 to be energized, which after a predetermined interval causes the relay contacts to be opened as by a warp or bimetal switch. Upon deenergization, there is a predetermined time delay which causes the switch contacts to be closed (as by cooling of the heated bimetal). This in effect delays the closing of the damper blade 30 to allow the products of combustion to be completely vented.

Since such delay relay means, as well as other equivalent solid state designs, are well known in the art, a detailed description of this element is not here included.

An additional redundant failsafe feature may also be added if required by interposing a thermostatic interruption switch (not shown) upstream of the damper blade which serves to open the motor circuit whenever the stack temperature exceeds a predetermined temperature, i.e., 170°–200° F., such that it is also prevented from closing at stack temperatures above 170° F.

The embodiments of the invention in which an exclusive property or privilege is claimed are defined as follows:

1. An automatic vent damper device for a combustion heating device of the type having a burner disposed in a combustion chamber and an exhaust vent ducting means for exhausting the products of combustion from said combustion chamber, said automatic vent damper device comprising:

a damper blade movably mounted in said vent ducting and adapted to allow the passage of said combustion gases in an open position and upon moving to a closed position, adapted to substantially close said exhaust vent ducting means;

a damper blade actuator arrangement comprising an electrically-operated actuator operative when energized to move said damper blade to said closed position;

bias means urging said damper blade to said open position, said electrically-operated actuator acting to overcome said bias means and move said damper blade to said closed position;

burner control circuit means energizing said electrically-operated actuator when said burner operation is discontinued;

a fusible thermal link disposed within said vent ducting means and means locating said fusible link in said duct means so as to come into direct contact with the products of combustion passing through said ducting means with said damper blade in said closed position, said means including a cut-out opening formed in said damper blade extending in from the periphery thereof and wherein said fusible link assembly is mounted in said ducting means so as to lie in said cut-out with said damper blade in said closed position, said fusible link comprising an electrically-conductive element which melts at a predetermined temperature in said vent ducting means corresponding to the operation of said burner with said damper blade in said closed position;

means for causing deenergization of said electrically-operated actuator upon melting of said fusible thermal link, said means including circuit means placing said fusible link in series with said burner control circuit means energizing said electrically-operated actuator whereby said automatic vent damper is failsafe in that in the event of burner operation with said electrically-operated actuator energized due to system malfunction, said electrically-operated actuator is deenergized by melting of said fusible link and interruption in said power of said electrically-operated actuator, allowing said damper blade to be opened by said bias means.

2. The automatic vent damper according to claim 1 wherein said electrically-operated actuator comprises a synchro-motor and wherein said damper blade is pivotally mounted within said vent ducting means and wherein said vent damper actuator further includes means causing rotation of said damper blade to said closed position by energization of said synchromotor.

3. The automatic vent damper according to claim 2 wherein said bias means comprises a torsional spring means opposing rotation of said damper blade by said synchro-motor and urging said damper blade to the open position.

4. The automatic vent damper according to claim 3 further including stop means positioning said damper blade in said open position and said closed position respectively against the urging force of said torsional spring in said open position and against said rotary force applied by said synchromotor moving said damper blade to said closed position.

5. The automatic vent damper according to claim 1 further including means preventing burner operation whenever said electrically-operated actuator has closed said damper blade.

6. The automatic vent damper according to claim 5 wherein said means preventing said burner operation includes limit switch means for controlling energization of said burner operation, said limit switch means including means closing said limit switch upon movement of said damper blade to said open position, whereby said furnace operation is precluded until said damper blade has moved to said open position.

7. The automatic vent damper according to claim 6 wherein said means drivingly connecting said synchro-motor output and said damper blade includes a drive gear drivingly connected to said damper blade and wherein said drive gear has a stop plate secured thereto so as to rotate together therewith, said stop plate adapted to engage said limit switch means upon rotation of said damper blade to said open position.

8. The automatic vent damper according to claim 7 wherein said stop means further is formed on said stop plate and includes a fixed abutment in the open position engaged by said stop means upon movement of said damper blade to said open position.

9. The automatic vent damper according to claim 4 wherein said stop means engaging said damper blade in said closed position comprises an abutment engaging said damper blade as said damper blade is rotated to the closed position by said electrically-operated actuator means.

10. The automatic vent damper according to claim 1 further including a damper housing adapted to be joined to sections of said vent exhaust ducting means, said damper housing means having said damper blade pivotally mounted therein, and wherein said actuator means includes actuator components mounted to said housing whereby said actuator device and said damper plate are mounted into said exhaust vent ducting means.

11. The automatic vent damper according to claim 10 wherein said damper housing is constructed of a cast metal, whereby to define a relatively rigid housing to prevent distortions thereof and which is corrosion-resistant to insure higher reliability of said damper blade movement.

12. The automatic vent damper according to claim 1 wherein said means for controlling operation of said electrically-operated actuator comprises a switching means operated by said burner control circuit means to deenergize said actuator whenever said burner is operated.

13. The automatic vent damper according to claim 12 wherein said switching means comprises a delay switch means controlling energization of said actuator, wherein said burner control circuit means energizes said delay switch means upon discontinuance of burner operation, and wherein said delay switch means energizes said actuator after a predetermined delay after energization of said delay switch means.

14. The automatic vent damper according to claim 12 wherein said switching means comprises a normally closed relay controlling energization of said actuator and wherein said burner control circuit means energize said normally closed relay whenever said burner control circuit means call for burner operation.

15. The automatic vent damper according to claim 12 wherein said switching means includes a solid state switching device controlled by said burner control circuit means which controls energization of said electrically-operated actuator device.

16. The automatic vent damper according to claim 15 wherein said solid state switching device comprises a blocking triac means connecting said burner control circuit means to said triac means to interrupt energization of said electrically-operated actuator device whenever said burner control circuit means causes operation of said burner.

17. The automatic vent damper according to claim 1 wherein said damper blade is formed with a cut-out opening allowing passage of products of combustion from a pilot burner and further including means mounting said fusible link in said opening whereby said fusible link may be mounted at the point within said ducting means whereat said damper blade is located, said damper blade movement in said exhaust duct means moving between said open and closed positions.

18. The automatic vent damper according to claim 1 further including a nonconductive spacer formed with a pair of openings extending along the length thereof, and further including conductive elements extending through said openings, said conductive elements extending out of said openings and wherein said fusible link is joined to said conductive element portions extending beyond said openings and further including means mounting said spacer extending with said fusible link into said ducting means.

19. The automatic vent damper according to claim 18 wherein said spacer is notched, said notches extending transversely to the axis of said spacer, wherein said means mounting said spacer includes a plate having a corresponding notch adapted to receive said spacer therein with said notches formed on said spacer and received within said slot formed in said plate to provide endwise location of said spacer.

20. The automatic vent damper according to claim 1 wherein said fusible link is interposed in said burner control circuit means so that by fusing of said link said burner control circuit means is deenergized whereby control signals calling for burner operation are discontinued.

21. The automatic vent damper according to claim 19 wherein said spacer is formed of a ceramic material.

22. The automatic vent damper according to claim 1 wherein said electrically-operated actuator includes a rotary electric motor, further including a drive gear driven by means driving said drive gear by said electric motor once the electric motor is energized wherein said biased force means includes a torsional spring and wherein said vent damper further includes means causing said torsional spring to be wound up in response to rotation of said driven gear by said rotary electric motor.

23. The automatic vent damper according to claim 22 wherein said damper blade is pivotally mounted within said ducting means and wherein said drive gear is drivingly connected to said damper blade so as to rotate therewith and wherein said torsional spring includes a spring disposed centrally with said axis of rotation of said drive gear and said damper plate.

24. The automatic vent damper according to claim 23 wherein said means drivingly connecting said drive gear with said damper blade includes a drive pin fixed to said drive gear and wherein said torsional spring is disposed about said drive pin, further including means connecting one end of said torsional spring to said drive gear and means anchoring said other end of said torsional spring whereby rotation of said drive gear causes wind up of said torsional spring in the direction opposite of said windings of said torsional wind up spring and wherein said direction is corresponding with the direction of rotation required to move said damper blade from said closed position to said open position.

25. The automatic vent damper according to claim 1 wherein said vent damper includes a damper housing, means pivotally supporting said damper blade in said damper housing so as to be movable between said open and closed positions and wherein said damper housing is formed with an internal shoulder adapted to engage said damper blade as said damper blade moves to said closed position.

26. The automatic vent damper according to claim 23 wherein said damper housing comprises a stepped outside diameter, the smaller of said stepped diameter adapted to mate with ducting of said furnace system with said larger diameter portion being formed with an internal diameter to receive said ducting of the same size as said ducting is received over said smaller diameter shoulder and wherein said inside diameter is formed with a shoulder adapted to located axially a section of ducting disposed therein.

27. The automatic vent damper according to claim 1 wherein said fusible link assembly melts at a temperature on the order of 400° F.

* * * * *